United States Patent [19]

Clark et al.

[11] 4,074,879

[45] Feb. 21, 1978

[54] TRACK SIGNALLING SYSTEM

[75] Inventors: Gary E. Clark, Henrietta; Klaus H. Frielinghaus; Barry L. Smith, both of Rochester, all of N.Y.

[73] Assignee: General Signal Corporation, Rochester, N.Y.

[21] Appl. No.: 745,703

[22] Filed: Nov. 29, 1976

[51] Int. Cl.[2] ..... B61L 21/06

[52] U.S. Cl. ..... 246/37; 246/34 CT

[58] Field of Search ..... 246/34 R, 34 CT, 40, 246/51, 54, 57, 37, 48, 122 R

[56] References Cited

U.S. PATENT DOCUMENTS

| | | | |
|---|---|---|---|
| 1,710,499 | 4/1929 | Lewis | 246/37 |
| 3,046,392 | 7/1962 | Luft | 246/34 CT |
| 3,529,150 | 9/1970 | Coupin | 246/40 |
| 3,794,833 | 2/1974 | Blazek | 246/34 CT |

*Primary Examiner*—Stephen G. Kunin
*Assistant Examiner*—Reinhard J. Eisenzopf
*Attorney, Agent, or Firm*—Milton E. Kleinman; George W. Killian

[57] ABSTRACT

A track circuit signalling system for an electrified rapid transit system using significantly fewer components is provided. Instead of a transmitter and receiver at each track circuit boundary, alternate boundaries have transmitters only; and the intermediate boundaries have two receivers. The coupling units for the two receivers are more economical than the prior art coupling unit for coupling the transmitter-receiver combination. The transmitters on each side of a receiver pair transmit signals on different carrier frequencies. Each transmitter transmits in both directions from its location. Of the two receivers at a given boundary, one is tuned to respond to signals from the transmitter on one side, while the other receiver of the pair is tuned to respond to signals from the transmitter on the other side. For special applications using overlapping track circuits, selected transmitters may be omitted and a single receiver used on each side of the omitted transmitter.

7 Claims, 5 Drawing Figures

TRACK SIGNALLING SYSTEM

BACKGROUND OF THE INVENTION

Sophisticated electrified rapid transit rail systems have been put into operation which provide high speed and maximum safety features. Such systems traditionally have a third rail which carries propulsion current and the running, or traction, rails are used as the return path for the propulsion current. For reasons which are understood by those skilled in the art, but which need not be explained further for the description of the present invention, it is desirable to assure that the traction rails carry approximately equal values of return propulsion current. In order to provide equalized current in the traction rails, it is necessary to provide low impedance electrical bonds between the rails at periodic intervals. The General Railway Signal Company of Rochester, New York provides bonds which are appropriate for this purpose and provide a wide variety of other useful features. The General Railway Signal Company bond is marketed under the name Wee-Z Bond. In addition to conducting return propulsion current, the traction rails are also used to transmit a variety of other signals which may convey information relating to allowable speed and other train controls. The rail bonds must not interfere with the other signals in the track. The General Railway Signal Company Wee-Z Bonds between the rails serve at least the following functions:

1. Equalize propulsion return currents between the traction rails.
2. Provide a means to cross-bond one track to a parallel track.
3. Provide a means to return the propulsion current to a substation.
4. Define the end boundaries of track circuits.
5. Provide a means for coupling a track circuit frequency, a cab signal frequency, and sometimes a wayside-to-train (TWC) signal frequency into the rails.
6. Provide a means for coupling a received track circuit signal frequency and a train-to-wayside (TWC) signal frequency from the rails into a receive signal cable.
7. Provide a very low impedance shunt to all frequencies in the rails to which the bond is not tuned in order to stop the propogation of unwanted signal frequencies in the track.

From the foregoing, it will be obvious that many design limitations are placed on a bond and that the bond may be required to conduct substantial currents between the rails. Accordingly, these bonds are relatively expensive and bulky items, and any means for making them simpler, more economical or reducing the number required will result in substantial savings.

As indicated, a variety of communicating and control signals may be passed through the rails. It is common practice to communicate such signals as modulated signals on a carrier wave. In prior art systems, a bond of the type described above is provided at each track circuit boundary. And at each boundary, a transmit and receive unit is provided. Adjacent track sections usually use different carrier frequencies to avoid any interference. Thus, at a particular boundary point, the receiver receives frequencies of one carrier frequency from one side of the bond and transmits signals at another carrier frequency to the other side of the bond. The distance between track circuit boundaries is determined by a variety of factors, some of which relate to physical conditions such as the location of switches; the location of stations; the location of highway crossings; and other factors with which those familiar with the art are aware. In addition, the distance between track circuit boundaries may be limited by the attenuation of the signal in the track.

SUMMARY OF THE INVENTION

The system of the invention provides for a more economical bond at alternate track circuit boundaries and a considerably more economical coupling unit at the intermediate boundaries. At the bond boundaries, only transmitter units are provided; and signals of a given carrier frequency are transmitted in both directions from the bond. At the intermediate boundaries, a simpler and more economical coupling unit is provided together with two receiver units; one of which is tuned to receive signals from the transmitter on one side of the coupling unit and the other of which is tuned to receive signals from the transmitter on the other side of the coupling unit. By this means, half of the bonds have been eliminated and replaced with simpler and more economical coupling units and half of the transmitter units have been eliminated. The bonds that remain are more economical, as the signal cable from the bond carries only transmit signals, and the expensive and bulky filters and decoupling networks to separate transmit and receive signals are not required. In like manner, the signal cable from the coupling units carry only low level receiver signals. This eliminates the need for decoupling networks and permits use of a simplified receive filter design. Thus, the system of the present invention can transmit and receive the same signals as the prior art, but can do so with reduced and more economical equipment, thereby resulting in substantial savings.

In applications wherein overlapped track circuit operation is desired, a transmitter may be omitted and a single receiver used each side of the omitted transmitters. The single receivers are tuned to respond to signals from the nearest transmitter on the far side of the omitted transmitter.

It is an object of the invention to provide an improved electrified rapid transit system.

It is a more specific object of the invention to provide a new and improved track circuit signalling system for an electrified rapid transit system which requires a reduced number of components.

It is another and even more specific object of the invention to provide a system in an electrified rapid transit system which provides the features of the prior art, but does so with a reduced number of components, at least some of which are considerably simpler and/or more economical.

It is another object of the invention to provide a system employing only transmitters at alternate track circuit boundaries and only receivers at the intermediate boundaries.

It is another object of the invention to provide a system which does not require both transmitters and receivers bridged across a signal pair.

It is another object of the invention to provide a system which uses a simpler receiver coupling unit as the signal pair carries only receive level signals.

DESCRIPTION OF THE PREFERRED EMBODIMENT

Figure 1:
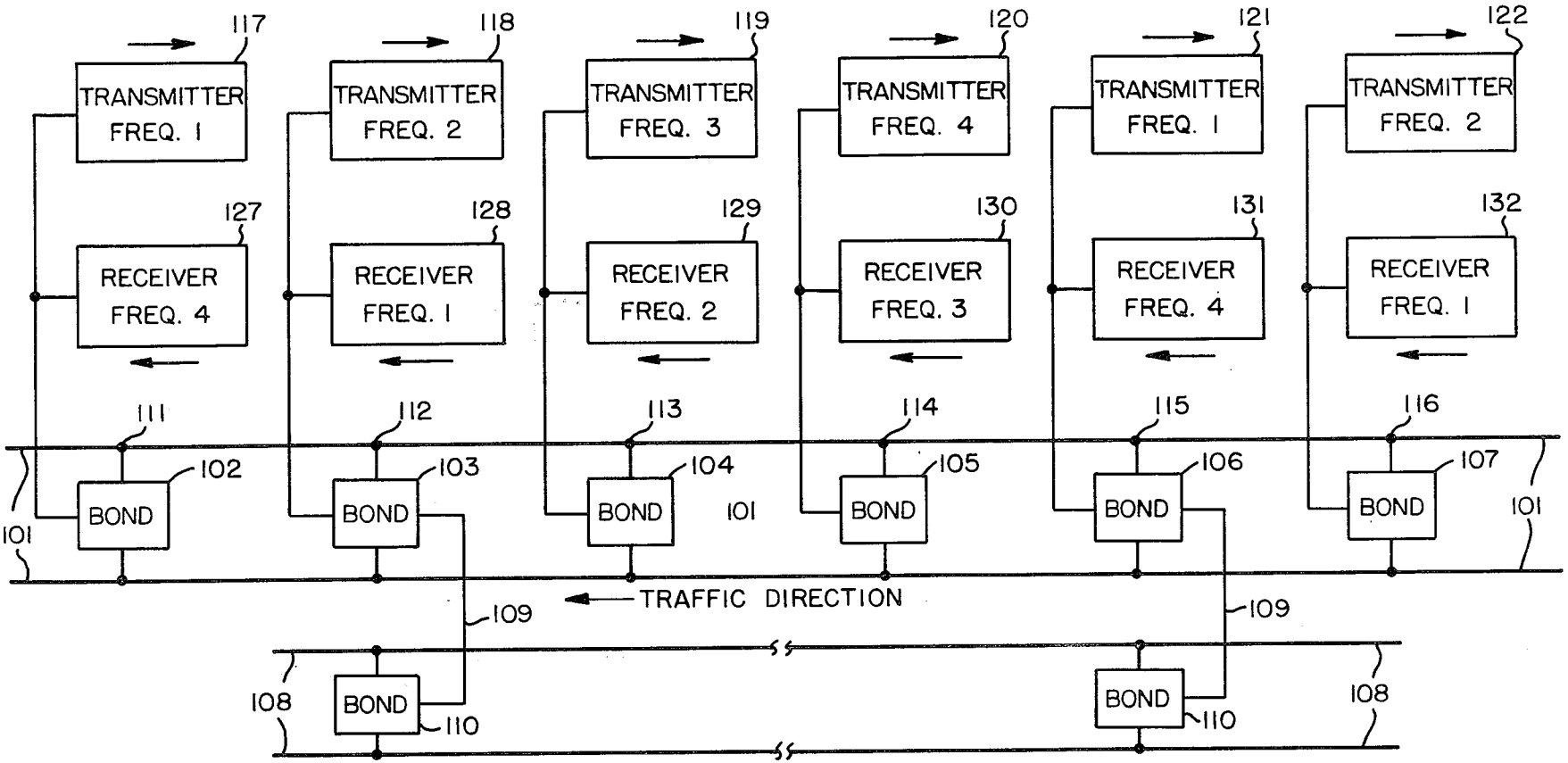
FIG. 1 (PRIOR ART)
FIG. 1 discloses a block diagram of the prior art equipment.

In order to more fully appreciate the features and advantages of the invention, it will be expedient to review the prior art techniques. For this purpose, consideration should be given to FIG. 1 wherein a pair of traction rails 101 of an electrified rapid transit system are shown. Propulsion current is provided through a third rail which is not shown in this illustration, as such rail is well known in the art and that rail plays no direct part in the system of the present invention. Bridged across the traction rails 101 are a plurality of bonds 102 through 107. The bonds 102 through 107 serve several functions including:

1. Equalization of propulsion return currents between the traction rails 101.

2. Provide a means to cross bond the rails of track 101 with a parallel track 108 by means of the cross bond link 109.

3. The bonds 102 through 107 together with the bonds 110 and the cross bond links 109 provide a means for returning the propulsion current to the substation.

4. Each bond defines the boundary of a track circuit and, therefore, the individual track circuit is defined as the distance between consecutively numbered boundary points 111 through 116.

5. The bonds 102 through 107 may also be used for coupling a track circuit frequency, a cab signal frequency and sometimes a wayside-to-train signal frequency into the rails.

6. The bonds also provide a means for coupling a received track circuit frequency and a train-to-wayside signal frequency from the rail into a receive signal cable.

7. The bonds also provide a very low impedance shunt to all frequencies in the rails to which the bond is not tuned in order to prevent the propogation of unwanted signal frequencies in the rails.

Frequency tuned bonds having the ability to provide the enumerated functions are available in the industry and one such bond is sold by General Railways Signal Company and designated a Wee-Z Bond. Although bonds are used in the system of the present invention, they are not described in detail herein, as they are standard articles of manufacture and are familiar to those who have experiences in the applicable arts.

As mentioned, each of the bonds 102 through 107 define the limits of a track circuit, thus, one track circuit may extend from boundary 111 to 112 and another track circuit extend from boundary 112 to 113, etc. The distance between boundary points may depend on numerous factors including, but not limited to, the frequency of the signals in the track circuit; the existence of highway crossings; station location; switch location and a variety of other factors. The distance between boundaries may vary from only a few hundred feet to several hundred feet, or a few thousand feet. Signals may be placed in the track and communicated from one track section to another, to wayside signals and/or to onboard equipment to indicate a wide variety of intelligence such as, but not limited to, an indication of track occupancy of a forward track section; allowable speed; condition of a forward switch; and other control data which will help assure rapid and safe operation. Signals may be coupled to a selected track section by an associated transmitter. For example, transmitter 117 is coupled to bond 102 and signals from transmitter 117 may be applied to the rails 101 by bond 102. The signals from transmitter 117 may be modulated signals on a carrier frequency of frequency F1 as indicated in the box 117. The carrier frequency signal will be transmitted in both directions from boundary point 111. The signal will be picked up at boundary point 112 and directed by bond 103 to receiver 128 which is tuned to receive signals of frequency F1. For this reason an arrow above transmitter 117 points to the right indicating that signals from transmitter 117 are transmitted to the right and detected by a receiver on the right. In a similar manner, signals from transmitter 118 with a carrier frequency F2 are conducted into the rail through bond 103 at boundary 112 and picked up at boundary 113 by bond 104 and received by receiver 129 which is tuned to frequency F2. The arrows below the receivers 127 through 132 point to the left indicating that they receive signals from a transmitter located to the left of the respective receivers. The signals from transmitters 117 and 118 are intended to be received by receivers 128 and 129, respectively. These signals might also be detected and received by receivers which are further to the right and which are tuned to the appropriate frequency. For example, receiver 132 might respond to signals from transmitter 117 if certain precautions are not taken. The principal precaution resides in the design of the intermediate bonds. Each bond is specifically designed to shunt out signals of any frequency to which the bond is not tuned. In addition, any residual signal which gets past a bond is attenuated by the track impedance. The result is that any signal from a transmitter which reaches a nonadjacent receiver is of such a low level as to be below the threshold of detectability. It should be observed that this principle also applies to receivers to the left of the transmitter and that, therefore, receivers 127 and 128 do not respond to signals from transmitters 120 and 121, respectively.

The prior art system described above is conventional and well known to those skilled in the applicable arts. It is apparent that at each boundary point 111 to 116 it is necessary to provide a transmitter (transmitting both track and cab signals), a receiver and a bond. Experience has shown that if bonds were provided only for the purpose of providing the necessary features relating to propulsion current, it would be possible to eliminate at least half of the bonds. That is, so far as the propulsion current requirements are concerned, bonds could be spaced further apart than the constraints required by other limitations relating to track signals.

Considering now more specifically FIG. 2, there is disclosed, and will be described, a system which provides features identical to that shown in the prior art system of FIG. 1, but which employs a reduced number of bonds and which eliminates other elements. An obvious result is that the system of FIG. 2 is more economical and requires reduced maintenance.

Figure 2:
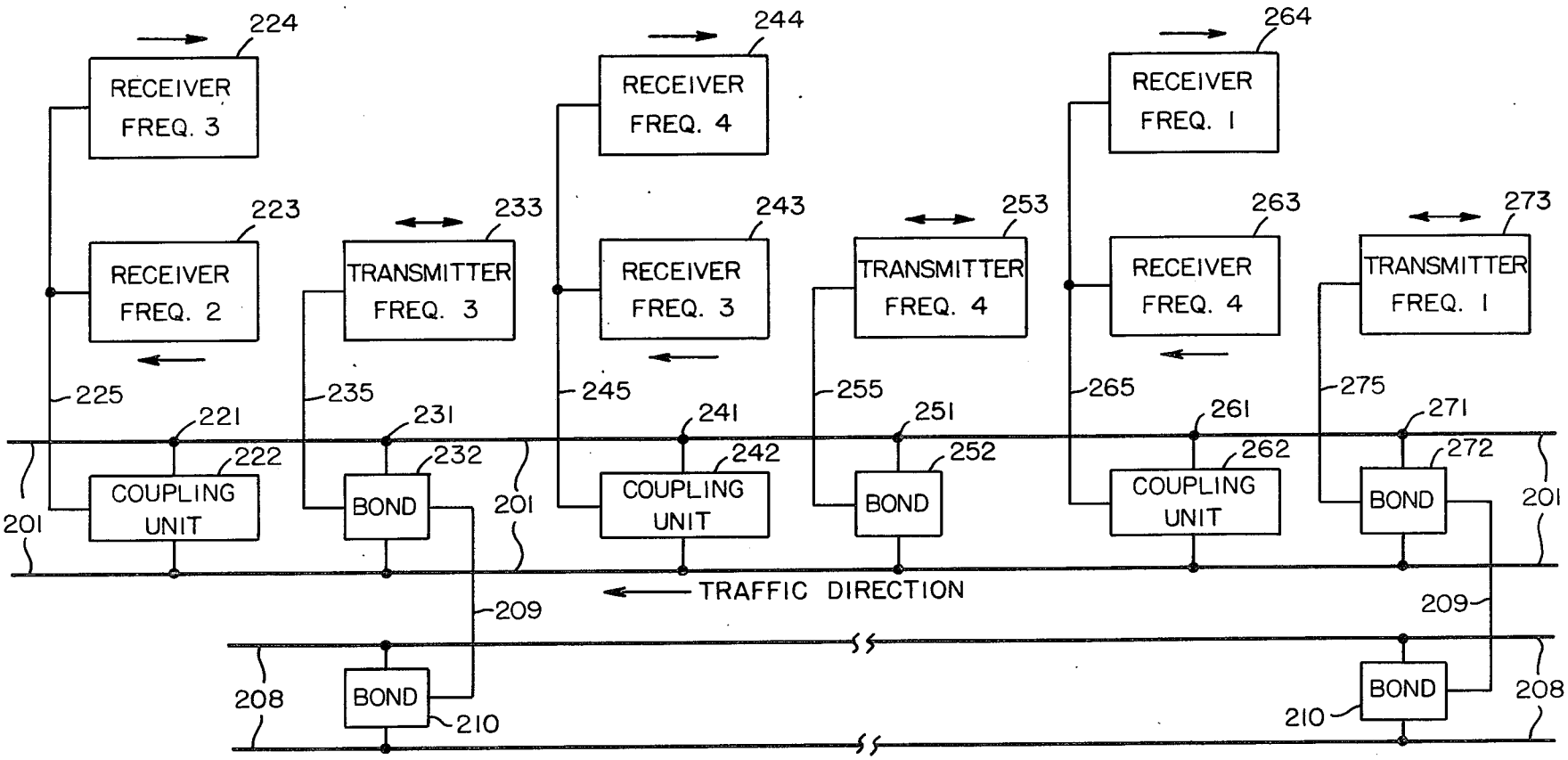
FIG. 2 discloses a block diagram of the components which collectively comprise the system of the invention.

Considering now more specifically the system of FIG. 2, it will be seen that there is a pair of traction rails 201, and there is illustrated a parallel track 208 which, if present, may be used as a parallel path to return the propulsion current to the substation. The track circuit boundaries are defined by points 221, 231, 241, 251, 261 and 271. At alternate boundary points, namely; 231, 251 and 271; bonds 232, 252 and 272, respectively, are provided. These bonds, 232, 252 and 272, are similar to the bonds 102 through 107 shown in FIG. 1, but are simpler and more economical since no receivers are connected and, therefore, no receiver tuned circuits are required. At the intermediate boundaries, namely; 221, 241 and 261; coupling units 222, 242 and 262, respectively are provided. The coupling units, 222, 242 and 262, provide all the necessary functions of the corresponding bonds in FIG. 1, but do not provide the functions relative to propulsion current return which, as pointed out with respect to FIG. 1, could be omitted from at least half of the bonds. In addition, there are no transmitters coupled to the coupling units 222, 242 and 262 and, therefore, these units are not required to include transmit capability. At each boundary point having a bond, there is coupled thereto a transmitter. For example, transmitter 233 is coupled to bond 232; transmitter 253 is coupled to bond 252 and transmitter 273 is coupled to bond 272. The transmitters of FIG. 2 are similar to the transmitters of FIG. 1, but as indicated in FIG. 2 by the arrows above the transmitters, transmission is in both directions on the rail 201. Actually, the transmitters of FIG. 1 also transmitted in both directions, but only the transmission in one direction was detected and received. Those familiar with the art will recognize that an exception is for cab signals on reverse running. In FIG. 2 the signals from transmitter 233 are transmitted in both directions from boundary 231 to boundary points 221 and 241. At boundary point 221 the signal is detected by coupling unit 222 and received by receiver 224 which is tuned to frequency F3 which corresponds to the carrier frequency of transmitter 233. In a similar manner, the signal transmitted from transmitter 233 is transmitted on rails 201 to boundary 241 and coupled through coupling unit 242 to receiver 243 which is also tuned to carrier frequency F3, which is the same as the carrier frequency of transmitter 233. In a similar manner, the transmitter 253 can transmit signals that are received by receivers 244 and 263. Thus, each transmitter 233, 253 and 273 transmits to two receivers and only half as many transmitters are required when compared with the system of FIG. 1.

It was pointed out with respect to FIG. 1, that the cable pairs from the bonds to the transmitter-receiver combination carried high level transmit signals and low level receive signals. The corresponding leads 225, 235, 245, etc. of FIG. 2 do not carry both signals. More specifically, leads 225, 245 and 265 carry only low level receive signals while leads 235, 255 and 275 carry only high level transmit signals. This allows simpler bonds 232, 252 and 272, as compared with the bonds 102 through 107 of FIG. 1. Similar simplification exists in the coupling unit 222, 242 and 262.

From the foregoing, it will be seen that the system of FIG. 2 provides the same features as the prior art system of FIG. 1. The system of FIG. 2 uses only half as many transmitters and, for half of the relatively bulky and expensive bonds, a simpler and more economical coupling unit is used.

Figure 3:
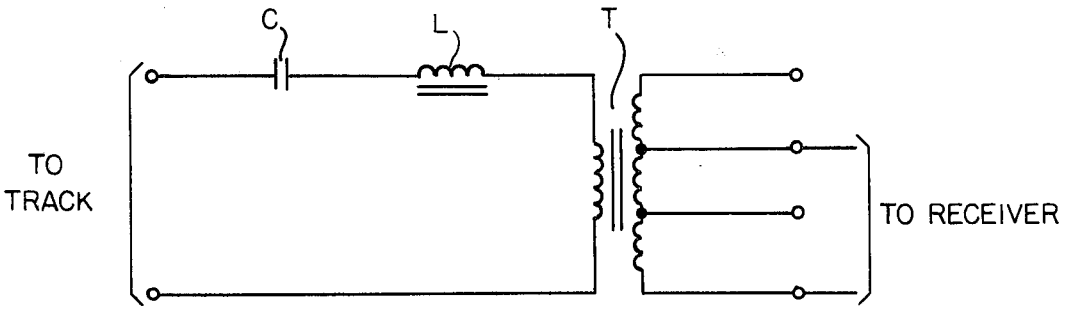
FIG. 3 discloses a receiver coupling unit in schematic form.

Considering now more specifically the coupling units 222, 242 and 262, it will be recalled, as set forth hereinabove, that these units are not required to handle propulsion current. Furthermore, the coupling units are only required to filter signals on the track and conduct those on either/or both of two selected carrier frequencies to an appropriate one of two coupled receivers. A coupling unit for one receiver might comprise a simple series tuned circuit such as that shown in FIG. 3. A series tuned coupling unit, as shown in FIG. 3, may have a low controlled (1 ohm) track impedance at its tuned frequency and will present a high impedance (of the order of approximately 10 ohms or more) to all other frequencies. The coupling circuit should have reasonable broken rail detection capability and, therefore, the receiver coupling unit must have a relatively low track impedance at its tuned frequency. Also, the receiver coupling unit must reflect similar shunting sensitivity and pre-shunt characteristics as the bond which it replaces and a low track impedance is also necessary for this purpose. In a normal application, as shown in FIG. 2, a transmit bond (such as 232, 252 and 272) feeds two receivers and, therefore, the loading effect of each receiver must be at a minimum so as not to affect the adjustment or reduce the shunting sensitivity of the other track circuit if any open circuit should occur in the track wiring or in the receive coupling unit of the first track circuit. The series tuned circuit of FIG. 3 having a relatively low impedance (1 ohm) at its tuned frequency and a high impedance to all other frequencies is admirably suited for the requirements. The capacitor C and inductor L of FIG. 3 tune the coupling unit to its receive frequency, and since they represent a series tuned circuit, minimum track impedance is provided at the resonant frequency. The multi-tap output transformer T steps up the impedance to a nominal 200 ohm maximum receiver line impedance. The available secondary taps on the transformer T provides a means of separately adjusting the input level to two terminating receivers operating from one transmitter. This is necessary since the two track circuits may be of different lengths resulting in different received track potentials at the two terminating receiver locations.

Figure 4:
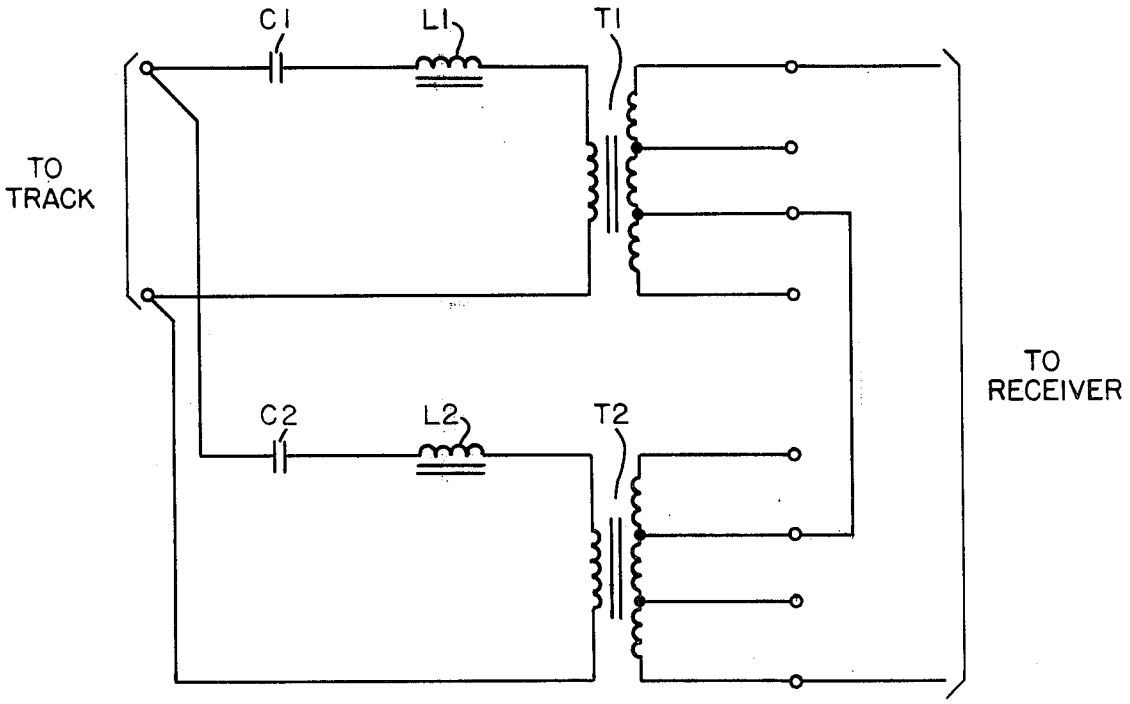
FIG. 4 discloses a receiver coupling unit for first and second receivers.

With two receivers used at a given boundary point, each fed from a different transmitter, a slightly different coupling unit is required from that shown in FIG. 3. To accomplish a double terminating receiver coupling unit, the circuit of FIG. 4 is provided. As may be seen from an examination of FIG. 4 and a comparison with FIG. 3, the circuit of FIG. 4 comprises two series tuned circuits connected in parallel. One of the series tuned circuits of FIG. 4 will be tuned to the frequency of the transmitter on one side while the other series tuned circuit of FIG. 4 will be tuned to the frequency of the transmitter on the other side. The secondary side of the output transformers T1 and T2 are connected in series to the receivers. The specific terminals to which connections are made on the secondary side of the transformers T1 and T2 provide for adjusting the input signal level. With the transformer outputs connected in series, only one receiver line wire pair is needed for the two receivers.

The distance between successive boundary markers, or track circuit boundaries, will vary depending on a number of factors with which those familiar with track layout are acquainted. When the distance between successive boundaries approaches 2,000 feet, the system of FIG. 2 is not always practical as generally it is desirable to have bonds not further apart than approximately 2,000 feet. Under such circumstances, the traditional techniques of the prior art as shown in FIG. 1, may be used.

Figure 5:
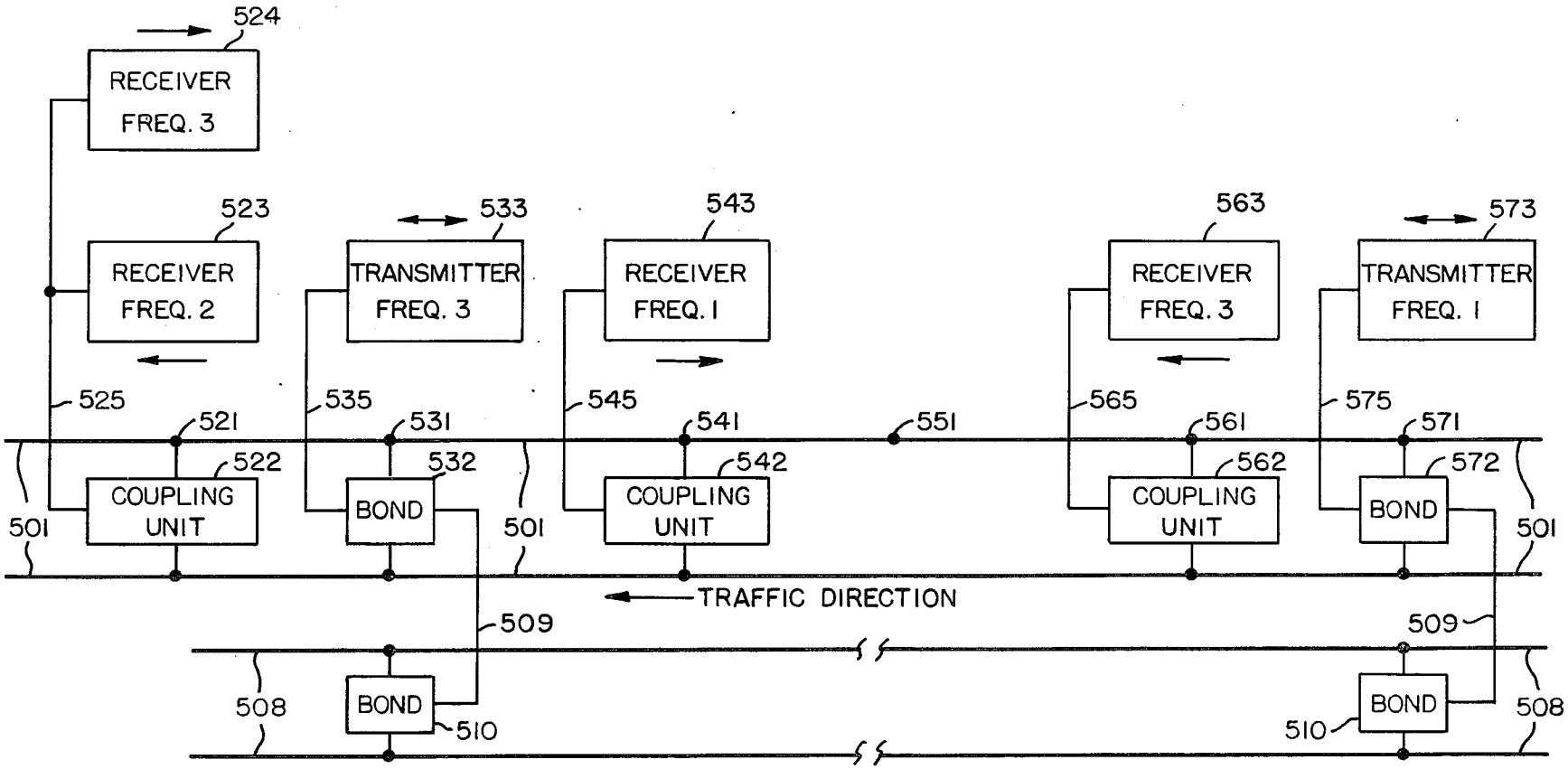
FIG. 5 is a block diagram of a modification of the system shown in FIG. 2.

In actual applications adapted to specific terrain, track layout and other operating requirements, the idealized and simplified arrangement shown in FIG. 2 may not always be the most economical. In some applications, overlapped track circuits are expedient, and a typical application is shown in FIG. 5. It will be observed that the layout of FIG. 5 is substantially identical to that of FIG. 2, except that in FIG. 5 selected components are not provided. Those components of FIG. 5 which correspond most directly with similar components in FIG. 2 are given identification numbers which correspond except for the first digit. It will be noted that in FIG. 5 the transmitter corresponding to transmitter 253 of FIG. 2 has been omitted and that receivers 244 and 264 as well as bond 252 have been omitted. In addition, receiver 243 of FIG. 2 which is tuned to frequency 3 is replaced in FIG. 5 by receiver 545 which is tuned to frequency F1 and, in a similar manner, receiver 263 of FIG. 2 which is tuned to frequency 4 is replaced by receiver 563 in FIG. 5 tuned to frequency 3. It will be seen in FIG. 5 that receiver 543 receives signals from transmitter 573 and that receiver 563 receives signals from transmitter 533. In overlapped track circuit operation, as illustrated in FIG. 5, single receivers are used at boundaries 541 and 561. Other overlapped operations and modifications will be apparent to those skilled in the layout of track circuits.

In other practical applications, there will be sections of track which may be arranged to use a combination of the prior art of FIG. 1, together with the techniques of FIG. 2 and/or FIG. 5.

While there has been shown and described what is considered at the present to be a preferred embodiment of the invention, modifications thereto will readily occur to those skilled in the related arts. For example, various signalling and modulation techniques could be used and cross bonds to parallel tracks could be omitted or could be made to include more than one set of parallel tracks for propulsion current return. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. In a track circuit signalling system comprising in combination:

(a) a two rail track divided into a plurality of contiguous track circuits separated by boundary markers;

(b) individual transmitter means, coupled to said track at alternate boundary markers by first coupling means bridged across said two rail track, for applying signals across said track at a carrier frequency and with the carrier frequency of each transmitter means differing from the carrier frequency of the nearest adjacent transmitter means on either side; and (c) one pair of individual receivers each coupled across said track at intermediate boundary markers by an individual second coupling means bridged across said two rail track with one receiver adapted to respond to track signals from the adjacent transmitter means on one side of the receiver pair and the other receiver of each receiver pair adapted to respond to track signals from the adjacent transmitter means on the other side of the receiver pair; and wherein (d) each said second coupling means comprises:

(1) a series tuned circuit with each pair of second coupling means coupled in parallel;

(2) an impedance matching transformer for producing an output signal is response to signals received from said track; and with (3) the output of the transformers of each pair of second coupling means coupled in series to provide a pair of output terminals.

2. The combination as set forth in claim 1, wherein each receiver of a receiver pair is coupled across said pair of output terminals.

3. The combination as set forth in claim 1, wherein said second coupling means has a low impedance at the frequencies of its associated receivers.

4. The combination as set forth in claim 3, wherein said second coupling means is further characterized in that it has a relatively high impedance at any frequency other than that of its associated receivers.

5. In a high frequency track circuit signalling system comprising in combination:

(a) a track divided into a plurality of contiguous track circuits separated by boundary markers;

(b) one each of a plurality of transmitters selectively coupled to said track at at least some alternate ones of said boundary markers;

(c) each of said transmitters adapted to apply signals to said track at a carrier frequency which differs from the carrier frequency of the nearest adjacent transmitter on either side; and (d) one pair, of a plurality of receiver pairs, coupled to said track at the intermediate boundary markers between alternate boundary markers to which transmitters are coupled;

(e) one receiver of each receiver pair adapted to respond to track signals from the adjacent transmitter on one side of the receiver pair and the other receiver of each receiver pair adapted to respond to track signals from the adjacent transmitter on the other side of the receiver pair; and (f) single receivers coupled to the track at the intermediate boundary markers on each side of an alternate boundary marker to which a transmitter is not selectively coupled, and wherein said single receivers are adapted to respond to track signals from a transmitter on the far side of the alternate boundary marker to which a transmitter is not coupled.

6. The combination as set forth in claim 5, wherein said receivers are coupled to said track at their respective boundary markers by a coupling circuit having a low impedance at the tuned frequency of the associated receivers.

7. The combination as set forth in claim 6, wherein said coupling circuits have a relatively high impedance to any frequency other than that of its associated receivers.

* * * * *